US006460535B1

(12) United States Patent
Nisewander et al.

(10) Patent No.: US 6,460,535 B1
(45) Date of Patent: Oct. 8, 2002

(54) HEAT SOURCE FOR RAIL EXPANSION

(75) Inventors: Stephen E. Nisewander, Cottage Grove; Russell A. Long, Eugene, both of OR (US)

(73) Assignee: Forrest Paint Company, Eugene, OR (US)

( * ) Notice: Subject to any disclaimer, the term of this patent is extended or adjusted under 35 U.S.C. 154(b) by 0 days.

(21) Appl. No.: 09/490,145

(22) Filed: Jan. 24, 2000

(51) Int. Cl.[7] ..... C10L 7/00

(52) U.S. Cl. ..... 126/271.1; 44/267; 44/519; 44/530; 228/119

(58) Field of Search ..... 126/271.1, 271.2 B; 44/266, 267, 519, 530; 102/312, 313; 228/119, 232; 29/402.21

(56) References Cited

U.S. PATENT DOCUMENTS 2,548,379 A * 4/1951 Lammersen ..... 44/519
3,343,931 A 9/1967 Doyle
3,923,472 A 12/1975 Martinez et al.
4,043,765 A * 8/1977 Tanner ..... 44/519
4,494,962 A * 1/1985 Christie et al. ..... 44/530
4,692,168 A * 9/1987 Dotson et al. ..... 44/530
4,786,290 A * 11/1988 Wyer ..... 44/519
4,830,611 A 5/1989 Guntermann et al.
4,860,727 A 8/1989 Eads et al.
5,037,409 A * 8/1991 Chen et al. ..... 604/358
5,662,719 A * 9/1997 Dawson et al. ..... 44/519
5,983,886 A * 11/1999 Allbeck ..... 126/271.2 B

* cited by examiner

*Primary Examiner*—Sara Clarke

(57) ABSTRACT

A tubular receptacle receives a flammable composition providing a heat source for the purpose of heating and expanding railroad rail segments defining a fracture at their ends. The receptacle is of a pliable nature and may include a fuse. The flammable composition includes alcohol and a petroleum product along with fragments of synthetic plastic fibers. A method is disclosed for utilizing the heat source.

18 Claims, 1 Drawing Sheet

HEAT SOURCE FOR RAIL EXPANSION

BACKGROUND OF THE INVENTION

The present invention pertains to the repair of metal structures which require thermal expansion in the repair operation.

In the railroad industry it is not uncommon to have rails fracture because of various reasons including fatigue, temperature extreme, loads borne, faulty ties. The repair of a fractured rail is accomplished by the welding together of the separated, spaced apart ends. Current practice in the repair of fractured rails includes the application of heat to rail segments adjacent the fracture to expand same to reduce the gap therebetween and permitting re-attachment of the ends by welding. Such fractures or separations are termed "pull-aparts".

Current practice in the repair of broken or separated rails entails the saturation of a length of rope with diesel oil and placement of the saturated rope along a rail segment. Ignition of diesel oil soaked rope, often by a hand held flare, serves to heat the rail segment expanding same. Such a practice is time consuming, messy and, more importantly, puts repair personnel at risk of serious burns from accidental ignition of oil soaked clothing. Environmental restrictions may also be violated by such a practice as the use of diesel oil as a heat source results in airborne pollutants and residue, several feet in length, remaining along the rail bed. As burning takes place necessarily for several minutes considerable amount of airborne pollutants are released in each repair operation. Also of environmental concern is the diesel fuel poured on a rail to be heated and then welded. The oil, when burned, heats the rail with the unburned oil soaking into the rail bed and ground.

SUMMARY OF THE PRESENT INVENTION

The present invention is embodied in a self-contained length of flammable material for placement on a damaged rail for heating of same in a repair operation.

The flammable core of the heat source is confined within a receptacle which permits convenient shipping, handling and installation on the rail. The composition includes an alcohol base with an additive to achieve a desired burn time and temperature for rail expansion. Ignition may be by a fuse applied to the pliable receptacle of the heat source. Sheath material is of minimal wall thickness to confine the flammable core in a secure manner while leaving minimal residue. The present article is placed lengthwise along a fractured rail segment and ignited applying heat to the segment for several minutes resulting in expansion of the segment to relocate the fractured ends toward one another to enable joining by welding. A fuse is preferably is applied to the sheath exterior to promote ignition. Ignition can be accomplished otherwise as by a fusee.

Important objectives include the provision of a heat source capable of heating several feet of a rail for expansion of same during repair of a rail pull-apart while minimizing pollution problems and reducing risk of burns to personnel encountered in the use of previous rail heating methods; the provision of a heat source capable of heating twenty or so feet of a railroad rail to the extent the rail expands lengthwise to position fractured rail ends proximate one another to enable rejoining of the rail ends by welding; the provision of a heat source which may be packaged, shipped and installed on a rail in a safe manner as flammable contents are confined with a non-injurious sheath; the provision of a heat source for heating metal structures such as a railroad rail and which utilizes synthetic fibers in combination with alcohol and fuel oil to provide the BTU output required for rail expansion.

DETAILED DESCRIPTION OF THE PREFERRED EMBODIMENTS

Figures 1, 2, 3, 4:
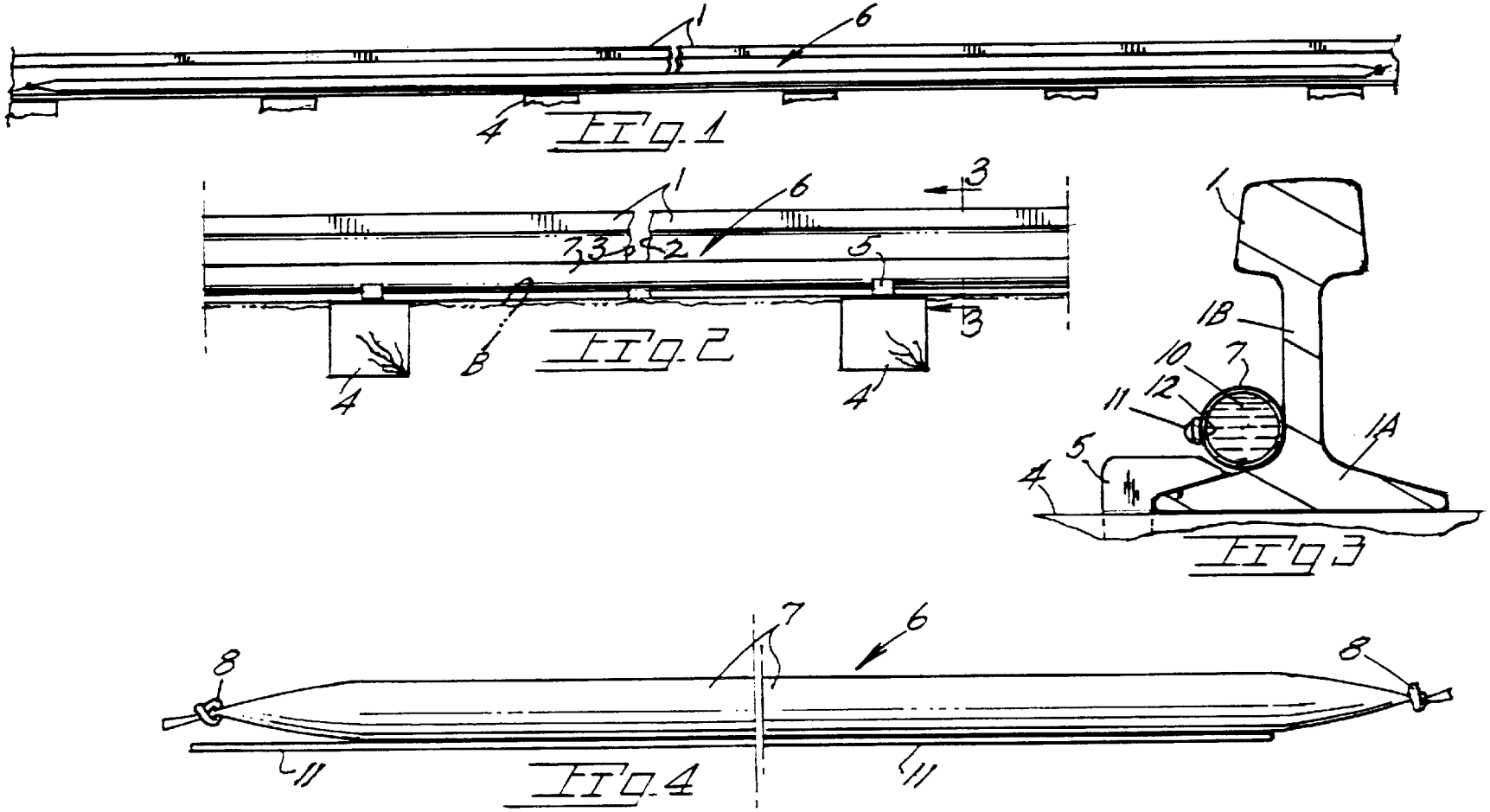
FIG. 1 is an elevational view of a damaged segment of rail with the present heat source in place.
FIG. 2 is an enlarged fragmentary view of FIG. 1.
FIG. 3 is a vertical sectional view taken along line 3—3 of FIG. 2.
FIG. 4 is a sectioned elevational view of the present heat source.

With continuing attention to the drawings, the reference numeral 1 indicates a rail segment having a fracture defined by ends 2–3. A rail base and web are at 1A–1B. A rail bed is at B on which ties 4 are supported. Spikes are at 5.

With reference to the present heat source for the expansion of a metal structure which, in the present disclosure, is a railroad rail, the heat source is indicated generally at 6 with a sheath at 7. The sheath is tubular and of pliable material, one suitable material being polyethylene approximately of two to five mil thickness into which the flammable mixture is deposited. The sheath ends may be closed as by tying at 8 or sealing as the polyethylene material is film-like to permit closure without seepage. Closure means also includes sealing or mechanical clamping of the ends. A polyethylene sleeve of two inch diameter and twenty five feet in length serves present purposes. The cross sectional dimension and length may be varied to best suit intended uses.

The flammable composition indicated at 10 and described below is a gel with an alcohol blend being the primary ingredient. In quantity of one hundred pounds the heat source (with a fuse 11), the ingredients are as follows in the preferred form of the invention.

| Description | Quantity | Percentage of Weight | Range of Percentage By Weight |
|---|---|---|---|
| Alcohol | 84.05 lb. | 84 | 70–99 |
| Hydroxypropyl cellulose | .81 lb. | 1 | 1–10 |
| Sodium chloride | .10 lb. | 0 | 0-5 |
| Nylon fibers | 10.09 lb. | 10 | 1–25 |
| #1 Fuel oil | 3.95 lb. | 4 | 1–10 |
| Fuse (if used) | 1.00 lb. | 1 | 0–10 |

The mixture is mixed in a tank and then extruded from a pressure vessel through a wand into the sheath which is closed at its remote end. Subsequent to closure, a fuse 11 may be attached. One suitable fuse is that manufactured by Four D Enterprises Inc. if San Diego, Calif. under the registered trademark STICKY MATCH-SLO and which is embodied in a length of encapsulated black powder on an adhesive bearing strip attached at 12 along sheath 7. As an alternative, a second mode of ignition is by using a hand held fusee or other ignition source such as a flare to light the heat source every few feet along its length. The ignited heat source is clean burning with little residue and no hazardous waste. A burn time of approximately fifteen to twenty minutes heats the rail to achieve desired rail expansion. In instances of extremely cold weather the present heat source may be paired, one atop the other on rail base 1A, to achieve desired rail expansion.

In the present flammable composition isopropyl alcohol serves as a base and burns clean while the hydroxypropy cellulose is a thickener increasing viscosity to that of a gel. Other alcohols may be suitable. Sodium chloride ensures the resulting flame is visable to repair personnel. The nylon fibers have an aromatic ring and when burned with #1 fuel oil serve as an accelerant to help dissolve the aromatic ring and increase BTU output. Polyethylene or polypropolene could be substituted for nylon fibers with some reduction in temperature and/or length of burn. Further, other classes of fuel oils may be used in formulating an accelerant.

In manufacture of the heat source the components are mixed in a tank and transferred to a pressurized vessel and extruded from the vessel via a wand inserted into each sheath. If desired, a fuse 11 may be applied, after sheath closure, to the full length of the sheath exterior.

#1 fuel oil comprises equal parts:

Kerosene;

Hydro Desulfurized Kerosene;

Hydro Desulfurized Middle Distillates; and

Straight Run Middle Distillates.

While we have shown but a few embodiments of the invention, it will be apparent to those skilled in the art that the invention may be embodied still otherwise without departing from the spirit and scope of the invention.

Having thus described the invention, what is desired to be secured by a Letters Patent is:

1. A flammable heat source for placement on a defective railroad rail for heating several feet of the rail during repair of the rail, said flammable heat source comprising, a pliable sleeve several feet in length, a flammable gel enclosed in said sleeve, said flammable gel including synthetic plastic fibers, said sleeve and flammable gel upon ignition serving to expand a corresponding length of rail preparatory to welding of the rail.

2. The heat source claimed in claim 1 wherein said sleeve is a tubular and closed at its ends.

3. The heat source claimed in claim 1 wherein said sleeve includes closure means at its ends to confine said flammable gel.

4. The heat source claimed in claim 1 additionally including a fuse, said fuse including an adhesive strip for adherence to said sleeve.

5. The heat source claimed in claim 1 wherein said sleeve is of combustible material of a thickness of two to five mils.

6. The heat source claimed in claim 5 wherein said sleeve is of synthetic plastic film.

7. The heat source claimed in claim 6 wherein said sleeve is of polyethylene.

8. The heat source claimed in claim 1 wherein said flammable gel includes isopropyl alcohol.

9. The heat source claimed in claim 1 wherein said flammable gel includes a cellulosic thickening agent.

10. The heat source claimed in claim 9 wherein said cellulosic thickening agent may comprise up to ten percent of the weight of the flammable gel.

11. The heat source claimed in claim 1 wherein said fibers are of nylon.

12. The heat source claimed in claim 1 wherein the flammable gel includes fuel oil.

13. The heat source claimed in claim 12 wherein said fuel oil is #1 fuel oil.

14. The heat source claimed in claim 1 additionally including a fuse, said fuse of linear shape and extending along at least a major portion of said pliable sleeve, said fuse comprising encapsulated black powder and an adhesive strip for adherence to the sleeve.

15. A method of making a heat source for use in the expansion of a metal structure during repair of the structure and including the steps of:

as mixing alcohol with a thickening agent and synthetic plastic fibers and fuel oil to provide a flammable gel, filling an elongate pliable receptacle with the flammable gel, positioning the filled elongate pliable receptacle in place on the metal structure, and igniting the flammable gel.

16. The method claimed in claim 15 including the additional step of attaching a fuse to said elongate pliable receptacle.

17. The method claimed in claim 15 including the additional step of attaching the fuse along the length of the receptacle.

18. A flammable heat source for placement on a railroad rail for heating of the rail during repair of the rail, said heat source comprising, a sleeve of synthetic plastic several feet in length and closed at its ends, said sleeve of pliable combustible material, a flammable gel occupying said sleeve and including alcohol, fuel oil and synthetic plastic fibers, said sleeve and flammable gel upon ignition serving to heat the rail to facilitate repair of the rail.

* * * * *